US007069657B2

(12) United States Patent
Culp et al.

(10) Patent No.: US 7,069,657 B2
(45) Date of Patent: Jul. 4, 2006

(54) METHOD TO REDUCE THE WIDTH OF A SLOT IN A PIPE OR TUBE

(75) Inventors: Darcy Culp, Leduc (CA); Don Graham, Edmonton (CA)

(73) Assignee: Reservoir Management (Barbados) Inc. (BB)

( * ) Notice: Subject to any disclaimer, the term of this patent is extended or adjusted under 35 U.S.C. 154(b) by 136 days.

(21) Appl. No.: 10/886,617

(22) Filed: Jul. 9, 2004

(65) Prior Publication Data

US 2005/0204528 A1 Sep. 22, 2005

(30) Foreign Application Priority Data

Mar. 22, 2004 (CA) ..... 2461522

(51) Int. Cl.
*B24C 1/10* (2006.01)
*B21D 31/06* (2006.01)

(52) U.S. Cl. ..... 29/896.61; 29/896.6; 29/896.62; 29/33 D; 29/33 T; 166/233; 166/74; 166/56

(58) Field of Classification Search ..... 29/90.7, 29/896.6, 896.61, 33 D; 166/233; 451/61; 72/370.27

See application file for complete search history.

(56) References Cited

U.S. PATENT DOCUMENTS

| | | | | |
|---|---|---|---|---|
| 965,855 | A | 8/1910 | Baur | |
| 1,027,917 | A | 5/1912 | Smith | |
| 1,028,065 | A | 5/1912 | Smith | |
| 1,028,066 | A | 5/1912 | Smith | |
| 1,055,675 | A | 3/1913 | Smith | |
| 1,207,808 | A | 12/1916 | Steps | |
| 1,207,809 | A | 12/1916 | Steps | |
| 1,271,787 | A | 7/1918 | Smith | |
| 1,566,624 | A | 12/1925 | Smith | |
| 1,579,846 | A | 4/1926 | Steps | |
| 1,652,208 | A | 12/1927 | Mcevoy | |
| 1,654,160 | A | 12/1927 | Coberly | |
| 1,654,618 | A | 1/1928 | Steps | |
| 1,685,287 | A | 9/1928 | Mcevoy | |
| 1,782,518 | A | 11/1930 | Steps | |
| 1,868,900 | A | 7/1932 | Hayes | |
| 2,111,680 | A | 3/1938 | Tow | |
| 2,306,945 | A | 12/1942 | Hebron | |
| 2,358,873 | A * | 9/1944 | Moss et al. | 72/100 |

(Continued)

FOREIGN PATENT DOCUMENTS

| | | |
|---|---|---|
| CA | 2183032 | 2/1998 |

(Continued)

OTHER PUBLICATIONS

Canadian Patent Application Serial No. 2,188,743, published Dec. 21, 1996.

(Continued)

*Primary Examiner*—David P. Bryant
*Assistant Examiner*—Christopher Agrawal
(74) *Attorney, Agent, or Firm*—Merek, Blackmon & Voorhees, LLC

(57) ABSTRACT

A method for reducing the width of slots spaced about the surface of a pipe or tube. The method comprises subjecting the surface of the pipe or tube to bombardment by a quantity of shot of a pre-determined size and for a pre-determined length of time to cause deformation of the surface of the pipe or tube adjacent to the slots therein so that the width of the slots is reduced to within a pre-determined size range.

16 Claims, 4 Drawing Sheets

U.S. PATENT DOCUMENTS

| | | | | |
|---|---|---|---|---|
| 3,009,177 | A | 11/1961 | Carusi | |
| 3,327,512 | A | 6/1967 | Novak | |
| 3,502,145 | A * | 3/1970 | Du Mee et al. | 166/227 |
| 3,520,418 | A | 7/1970 | Guinard | |
| 4,179,911 | A | 12/1979 | Saier | |
| 4,932,112 | A | 6/1990 | Tikkanen | |
| 5,702,289 | A * | 12/1997 | Champaigne | 451/38 |
| 6,112,570 | A | 9/2000 | Hruschak | |
| 2004/0016278 | A1 | 1/2004 | Douman et al. | |
| 2004/0244449 | A1 | 12/2004 | Hruschak et al. | |

FOREIGN PATENT DOCUMENTS

| | | |
|---|---|---|
| CA | 2324730 | 4/2002 |
| CA | 2464631 | 10/2004 |
| DE | 3213464 | 10/1983 |
| JP | 54-4386 | 4/1979 |
| JP | 62097727 A * | 5/1987 |
| WO | WO 02/34423 | 5/2002 |

OTHER PUBLICATIONS

Canadian Patent Application Serial No. 2,299,092, published May 15, 2000.

European Patent Application Serial No. 0297552, published Jan. 4, 1989.

U.S. Appl. No. 10/886,617, filed Jul. 9, 2004 and entitled "Method and Apparatus to Reduce the Width of a Slot or Opening in a Pipe, Tube or Other Object."

U.S. Appl. No. 10/941,838, filed Sep. 16, 2004 and entitled "Method and Apparatus to Reduce the Width of a Slot or Opening in a Pipe, Tube or Other Object."

Combined Search and Examination Report dated Sep. 28, 2005.

Combined Search and Examination Report dated Jul. 21, 2005.

* cited by examiner

METHOD TO REDUCE THE WIDTH OF A SLOT IN A PIPE OR TUBE

FIELD OF THE INVENTION

This invention relates to a method to reduce the width of a slot or opening in a pipe, tube or other object, and in one aspect to a method to reduce the width of slots in tubular liners for bore holes.

BACKGROUND OF THE INVENTION

Slotted metal pipes, or tubulars as they are often known, have been used for a considerable length of time in oil, gas and water wells as a means to limit the amount of sand or debris allowed to enter the tubular as oil, gas or water is drawn in from surrounding underground formations. The slotted tubulars effectively act as a liner and screening mechanism to permit the desired fluid to be drawn into the tubular for extraction while excluding sand, rock and other particles. Tubular liners must have slots that are sufficiently small in width to prevent particulate matter from entering the pipe, while maintaining sufficient structural integrity to withstand pressures to which they may be subjected in underground environments, particularly in wells having horizontal components.

The difficulty encountered with slotted tubulars is not so much in their use but in their method of manufacturing. The particular underground formation within which the tubular is to be deployed will for the most part dictate a maximum slot width that will be acceptable. In oil and gas well applications, it is often the case that the oil or gas being targeted is located in formations comprised of fine sand particles. In such situations it is not unusual to require a slot width in the tubular of 0.010 of an inch, or less. Unfortunately, conventional manufacturing equipment is rarely capable of cutting slots in tubulars having a width less than 0.015 inches. As a result, manufacturers commonly subject slotted tubulars to a secondary seaming process where rollers are used to apply pressure to the tubular in the vicinity of the slot, having the result of narrowing the slot width at the exterior surface and forming a slot with a keystone, parabolic, or similar shaped profile.

A variety of different seaming methods have been proposed by others as a means to reduce the width of slots formed in tubulars through conventional mechanical methods. Such methods include those described under U.S. Pat. No. 6,112,570, dated Sep. 5, 2000; Canadian patent 2,183,032, dated Jul. 17, 2001; and, Canadian patent 2,324,730, dated Aug. 12, 2003.

Although the seaming methods that have been used by others have been generally successful, they also suffer from a number of inherent limitations. First, the equipment necessary to perform the seaming operation is relatively complex and often necessitates a precise alignment of seaming rollers on the surface of the tubular in order to ensure a full and complete seaming of all slots. To successfully narrow each slot, the feed rate of the tubular through the seaming equipment must also be kept relatively low, resulting in a low production rate. In an attempt to avoid the necessity of precise alignment of the seaming rollers with the slots in the tubular, some have suggested moving the seaming rollers in a helical sweeping pattern across the entire surface of the tubular. While doing so may alleviate the need for precise alignment of the rollers, it also results in the entire surface of the pipe being contacted by the seaming rollers, a process that once again is time consuming and results in a relatively low throughput. The equipment utilized is also expensive and adds significantly to the capital commitment on the part of the manufacturer.

SUMMARY OF THE INVENTION

The invention therefore provides a method to reduce the width of a slot or opening in a pipe, tube or other object that addresses many of the deficiencies in the prior art. In one aspect the inventive method permits slots in a tubular element to be quickly and efficiently reduced to a desired width, and in a manner that permits a production rate that is generally well beyond that achievable through the use of currently available manufacturing equipment and methods. The method further removes the need for alignment of seaming rollers with the slots in the tubular, and minimizes the amount of equipment necessary in the manufacturing process, having the effect of reducing capital investment and also reducing the square footage requirement for a manufacturing facility.

Accordingly, in one of its aspects the invention provides a method for reducing the width of slots spaced about the surface of a pipe or tube, the method comprising subjecting the surface of the pipe or tube to bombardment by a quantity of shot of a pre-determined size and for a pre-determined length of time to cause deformation of the surface of the pipe or tube adjacent to the slots therein such that the width of the slots is reduced to within a pre-determined size range.

In a further aspect the invention provides a method for reducing the width of slots or openings upon the surface of an object, the method comprising subjecting the surface of the object to bombardment by a quantity of shot having a pre-determined size and for a pre-determined length of time such that the impact of the shot against the surface of the object adjacent to the slots or openings therein causes a deformation of the exterior surface of the object resulting in a reduction in the width or size of the slots or openings within the surface of the object.

The invention also concerns a method to reduce the width of slots in tubular liners used in oil, gas or water wells so that the width of the slots is sufficiently small to prevent or limit the ingress of sand, rock, or other particulate material into the interior of the tubular liner when the liner is inserted into a bore hole, the method comprising subjecting the exterior surface of the tubular liner to bombardment by a quantity of shot of a pre-determined size and for a pre-determined length of time such that the impact of the shot against the exterior surface of the tubular liner causes metallic deformation of the surface of the liner adjacent to the slots and a resulting reduction in the width of the slots.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
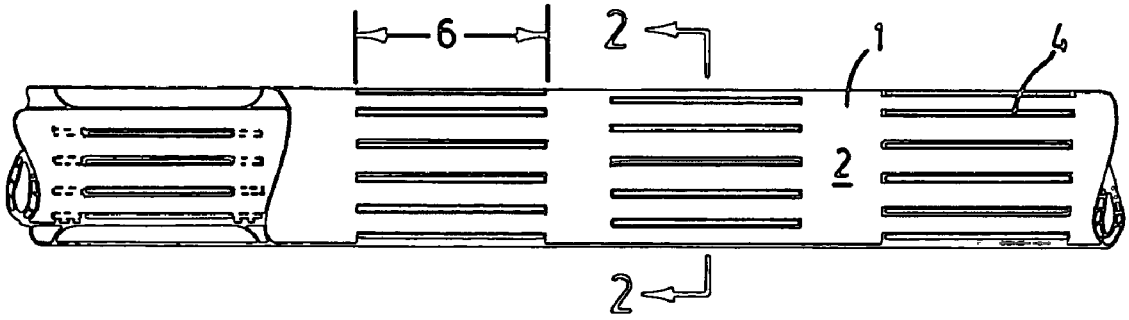
FIG. 1 is a side elevational view of a tubular element having slots formed in its exterior surface through conventional methods.
Figure 2:
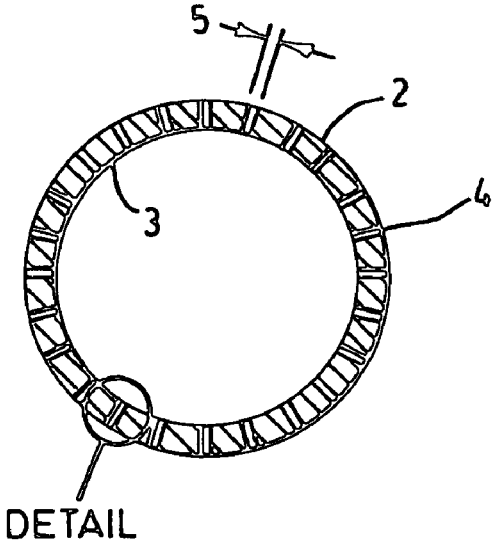
FIG. 2 is a sectional view along the line 2—2 of FIG. 1.
Figure 3:
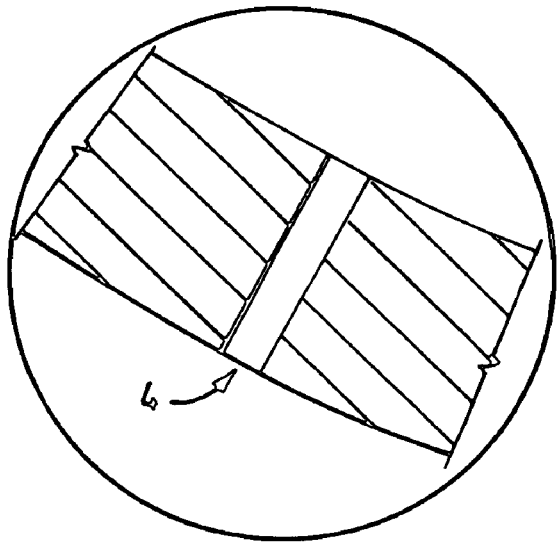
FIG. 3 is an enlarged detail view of a portion of the tubular element shown in FIG. 2.

In accordance with one of the preferred embodiments of the method of the present invention there is provided a pipe, tube or tubular element 1 having an outer surface 2 and an inner surface 3 (see FIG. 1). Spaced about the outer surface of tubular member 1 is a series of slots 4, having a width 5 and a length 6, that extend through the pipe's wall (see FIGS. 1, 2 and 3). Typically slots 4 will be spaced about the surface of tubular element 1 in general alignment with the longitudinal axis of the tubular member and in a repeating pattern. However, it will be appreciated by those skilled in the art that the method described herein may be equally applied to tubular members having slots of different orientation and/or randomly positioned about the surface of the tubular. The invention is also not limited to tubular members of any particular length and may be used on relatively short lengths of pipe, elongated tubulars, or continuous rolls of tubing. It should also be appreciated that the diameter of the tubular members may vary depending upon their end use, but that the described method may be applied to essentially any diameter of pipe. Where the tubular members are to be used as liners in oil, gas, or water wells, typically they would have lengths ranging from approximately 20 to 45 feet, and diameters from 2 to 12 inches.

The manner in which slots 4 are cut or formed within tubular member 1 is, for the most part, of minor consequence to the current method of reducing slot width. Most commonly the slots will be formed through the use of a mechanical cutting tool or milling machine, although, more sophisticated equipment, including lasers, could also be used. Regardless of how the slots are formed, the basis for the present invention is a requirement for the width of the slots to be reduced to less than can be currently achieved, either technically or economically. Once the tubular members have been slotted they may be then subjected to the process described herein in order to reduce the width of the slots to an acceptable and desired range.

Figure 4:
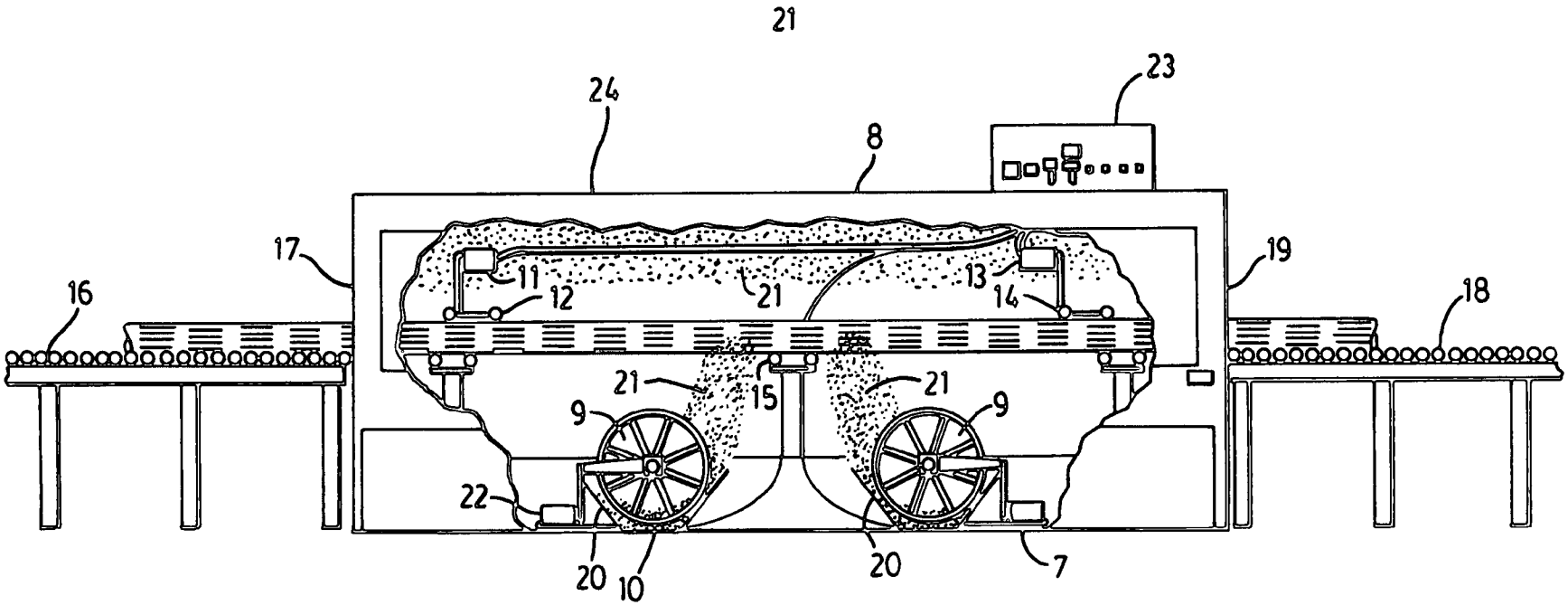
FIG. 4 is a side sectional view through an apparatus constructed to carry out the method of the present invention.
Figure 7:
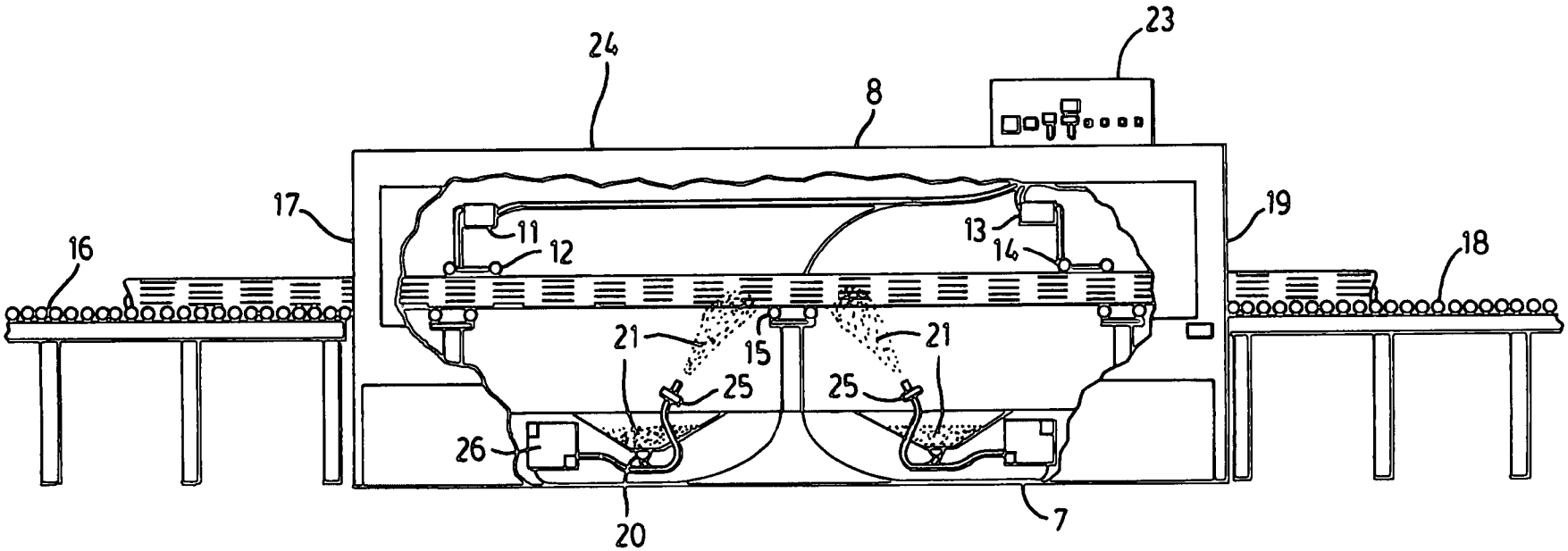

According to the present invention, the slotted tubular members are subjected to bombardment by a quantity of shot of a pre-determined size and for a pre-determined length of time in order to cause deformation of the surface of the tubular member such that the width of the slots is reduced by a desired degree. In order to subject the surface of the tubular member to the bombardment process, the tubular is typically inserted into a blast cabinet within which shot is fired or hurled against its surface. The method of blasting or hurling the shot against the tubular can vary and a variety of different types of machinery from wheel blasting through to pneumatic or air blasting machines can be utilized. For illustration purposes the enclosed drawings provide examples of two forms of machinery that may be used to accomplish the bombardment process. In FIG. 4 there is depicted a simplified drawing of the primary components of a wheel blasting machine that may be used for such purpose. In FIG. 7 the primary components of an air or pneumatic blasting machine 24, that be used to carry out the bombardment process, are shown.

In FIG. 4 there is shown a wheel blasting machine 7 that is generally comprised of a blast cabinet 8 having located therein one or more impellers 9 that include a series of vanes or blades 10. In FIG. 4 the use of two impellers is shown, however, it should be noted that for reasons that will be discussed in more detail below, one, two or more impellers maybe utilized while remaining within the broad scope of the invention. Wheel blasting machine 7 will most often include a feed motor 11 connected to one or more feed rollers 12 that contact the exterior surface of tubular member 1, causing the tubular member to move longitudinally through blast cabinet 8. The wheel blasting machine may also include a separate rotary drive system comprising a motor 13 and one or more rollers 14 to impart rotational movement to tubular member 1 as it is fed through the blast cabinet. In alternate embodiments of wheel blasting machine 7, the feed and rotational drive systems may be combined within a single unit, or the feed and rotary drive systems may be comprised of a stand alone piece of equipment mounted at either end of the wheel blasting machine. A series of rollers 15 are typically positioned at various points throughout the interior of blast cabinet 8 in order to support tubular member 1 as it is fed through the machine. Depending upon the particular configuration of the manufacturing facility in question, there may also be utilized a set of rollers 16 at the front end 17 of the wheel blasting machine, and a further set of rollers 18 at the rear end 19 of the machine in order to support tubular the member as it is fed into and as it exits the blast cabinet.

As shown in FIG. 4, wheel blasting machine 7 further includes a hopper or impeller housing 20, positioned about each impeller, into which is received a quantity of shot 21. The impeller is located within blast cabinet 8 at a point such that rotation of the impeller causes blades 10 to pick up shot from housing 20 and hurl it against the exterior surface of tubular member 1. After striking the surface of the tubular member the shot falls under the influence of gravity back down into the impeller housing to eventually be once again hurled against the surface of the tubular element as the impeller continues to rotate.

Figure 5:
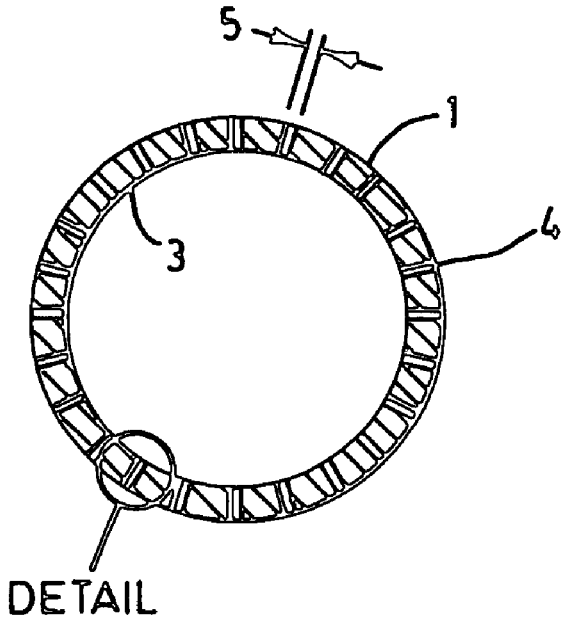
FIG. 5 is a sectional view of the tubular element shown in FIG. 1 along the line 2—2 following subjection of the tubular element to the method of the present invention.
Figure 6:
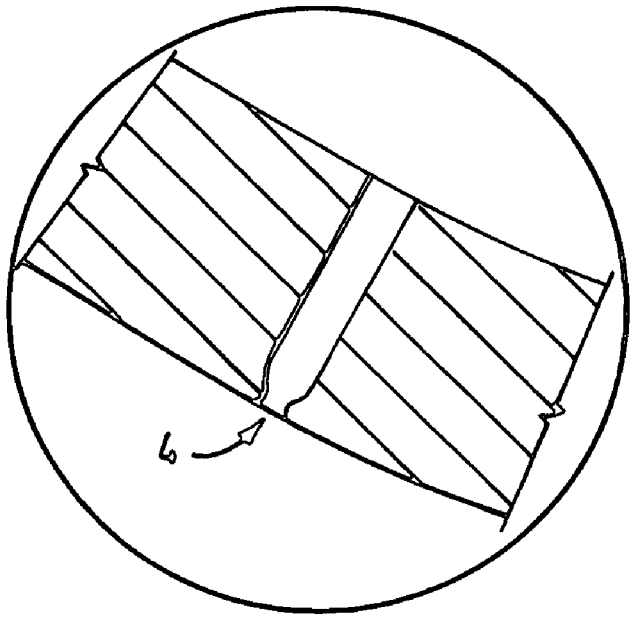
FIG. 6 is an enlarged detail view of a portion of the tubular element shown in FIG. 5; and, FIG. 7 is a side sectional view through an alternate apparatus constructed to carry out the method of the present invention.

Through subjecting the exterior surface of tubular member 1 to bombardment by shot 21, it has been discovered that the surface of the tubular adjacent to slots 4 can be deformed causing a reduction in the width of the slots. That is, as individual shot pellets strike the exterior surface of the tubular member their kinetic energy is dissipated through the metallic surface of the tubular causing a mechanical deformation of outer surface 2 and resulting in a portion of the metallic surface flowing or being driven into slot 4, thereby effectively reducing its width. It has also been determined that the effect of the bombardment of the exterior surface of the tubular member is relatively superficial and that it causes a narrowing of the width of the slots across the outer surface of the tubular member but has little or no effect upon the width of the slot at its inner surface. In this fashion a keystone, parabolic or similar shaped slot is created without the necessity of utilizing seaming rollers as has previously been the case (FIGS. 5 and 6). A protective film or coating may be applied to the tubular after bombardment.

In order to ensure that a sufficient amount of energy is transferred from the shot to the exterior surface of the tubular, and to prevent the destruction of shot pellets upon their striking the tubular, the shot is preferably comprised of high strength or high carbon steel, stainless steel or other high impact resistant material (including other metallic alloys and ceramics). The particular composition of the material from which the shot is formed may vary depending upon the composition of the tubular member that is being bombarded and having regard to other process considerations. Where the tubular member in question is to be used as a liner in an oil, gas or water well, shot formed from heat treated steel (for example martensite), having a Rockwell Hardness of between 40 and 50, has been found to perform satisfactorily. It should also be noted that for some applications it may be desirable to prevent or limit the plugging or lodging of shot within slots 4. In such cases the shot will preferably be of a size greater than the width of the slots in the tubular member, for example, from five to ten times the width of the slots, or at least 25 percent larger that the slot width, prior to bombardment of the tubular. In other instances plugging may not be of significant concern and smaller shot (or a range of shot sizes) may be utilized. Most commonly, the individual shot pellets shot will be generally spherical in shape, having diameters within a defined size range.

Through controlling the feed rate of tubular member 1 and the rate at which it is rotated about its longitudinal axis as it passes through blast cabinet 8, the "degree of coverage" for shot that is blasted or hurled against the exterior surface of the tubular can be closely controlled. The number of times that a specific portion of the exterior surface of the tubular member must be impacted by a shot pellet in order to sufficiently deform the surface to reduce the width of the slots by a desired amount will be largely a function of the tubular member, the kinetic energy of the shot as it strikes the surface of the tubular member, and the amount by which the width of the slots must be reduced. As indicated above, there is a degree of flexibility with respect to the choice of shot size, provided that the shot is larger than the width of the slots to prevent the slots from being clogged during the bombardment process. The material from which the shot is formed may also be varied in some instances to increase its density, and its kinetic energy at the time of impact with the tubular member. Choosing a larger shot size will also generally enhance the amount of kinetic energy available for transference to the surface of the tubular member upon contact. However, there will come a point where increasing the size of the shot pellets may eventually have a detrimental effect upon the ability to consistently reduce slot size. As the size of the pellets is increased there will be a greater tendency for pellets to bounce off one another and to be deflected away from their target zone on the surface of the tubular. A significantly increased shot size will also mean that adjacent pellets simultaneously striking the surface of the tubular will have greater interstitial spaces between them, potentially leaving small portions of the surface of the tubular member untreated, except under prolonged exposure to bombardment.

Since obtaining an adequate level of bombardment by shot pellets to effect the desired degree of reduction in slot width is of primary importance when utilizing the method described herein, a number of operational factors, over and above feed rate and shot size, must be also be considered. These factors include the number of impellers operating within the blast cabinet, the rotational speed of the impellers, the volume of shot present in the blast cabinet, the rate of rotation of the tubular as it passes through the wheel blasting machine and the diameter of the tubular. For example, increasing the number of impellers hurling shot at the tubular member, while maintaining other factors the same, will increase the rate at which the exterior surface of the tubular member is bombarded and will have a corresponding increase in the maximum feed rate through the system. In the wheel blasting machine shown in FIG. 4 there are two impellers operating, effectively doubling the amount of shot that his hurled against the surface of the tubular member for any given length of time (compared to having one operating impeller). Adding a third impeller to the machinery would further increase the bombardment of the tubular member and permit a faster feed rate or, alternatively, a potentially more significant reduction in slot width.

It will also be appreciated that the speed of rotation of impeller 9 can be varied to impart increased or decreased levels of kinetic energy to the shot as it is hurled against the outside surface of the tubular. Typically the impeller will be driven at a speed of between 1800 and 3600 rpm, but within that range the precise speed may be controlled to obtain a particular end result. Increasing impeller speed will generally increase the rate of bombardment of the surface of the tubular and may permit an increased feed rate.

Maintaining a sufficient volume of shot within the machinery is also important to ensure full surface treatment of the tubular. Low volumes of shot will mean that the tubular will be bombarded with fewer pellets per unit time, requiring a slower feed rate through the wheel blasting machine. However, care must also be taken not to overload the equipment with too much shot. Too much shot can place an excessive load on the impeller drive system, causing mechanical failure or a decrease in impeller speed and a resulting decrease in bombardment of the tubular with a corresponding decrease in the effective feed rate.

The number of impellers operating in the machine, and their rate of rotation, will also have a direct impact upon the speed at which the tubular should be rotated as it passes through blast cabinet 8. Rotation of the tubular allows its entire exterior surface to be exposed to shot hurled from the impellers. Accordingly, increasing the number of impellers hurling or firing shot at the tubular permits both a faster rate of rotation and a faster feed rate through the machine. To ensure adequate and complete surface treatment, consideration should also be given to the diameter of the tubular. Since smaller diameter tubulars have a smaller exterior surface area that must be treated, in general they may be rotated faster and may permit a faster feed rate than large diameter members.

Of course, increasing the amount by which the width of the slots in the tubular must be reduced has the general effect of requiring a reduced feed rate and a reduction in the rate of rotation of the tubular. To offset the reduced rate of productivity, the speed of the impellers may be increased and/or there may be an increase in the number of impellers operating within the machine.

To simplify and automate its operation, wheel blasting machine 7 may be controlled by a microprocessor 23 with one or more of the above factors calibrated and programed into the microprocessor. In such cases, accommodating tubulars or other objects of differing diameters or sizes, or having slots or opening of varying widths, merely requires an operator or input new feed stock criteria into the microprocessor control so that appropriate adjustments can be made to applicable operating parameters, including feed rates, rotational rates, and impeller speed.

As indicated previously, the method according to the present invention may be equally carried out through the use of air or pneumatic blasting machine 24 (see FIG. 7). The general overall process is essentially the same regardless of whether a wheel or pneumatic blasting machine is utilized. However, in the case of a pneumatic blasting apparatus, the shot will be hurled against the exterior surface of the tubular by means of a nozzle 25 connected to a source of pressurized air 26. As in the case of wheel blasting machine 7, pneumatic blasting machine 24 may incorporate one, two or more nozzles. The nozzles may be positioned in a row generally parallel to the tubular or, alternatively, may encircle the circumference of the tubular, in which case rotation of the tubular as it passes through the pneumatic blasting machine may become unnecessary.

To better demonstrate the method described herein, reference will now be made to the following two examples.

EXAMPLE 1

A slotted casing (38.69 kg/m L80 Ipsco) having a diameter of 117.8 millimeters and an initial slot width of 0.020 inches was subjected to bombardment by a quantity of shot in a wheel blasting machine utilizing two separate impellers. A spherical shot formed from heat treated steel of generally uniform structure of finely tempered martensite was loaded into the wheel blaster. The shot had a size such that 96% of the pellets were greater than Tyler screen 25 and had a Rockwell Hardness between 40 and 50. The casing was fed through the wheel blasting machine at a rate of 10 feet per minute, resulting in a reduction in the slot size with the treated casing having slots of a width of 0.010+/−0.002 inches.

EXAMPLE 2

A slotted casing (38.69 kg/m L80 Ipsco) having a diameter of 177.8 millimeters and an initial slot width of 0.020 inches was subjected to bombardment by a quantity of shot in a wheel blasting machine utilizing two separate impellers. A spherical shot formed from heat treated steel of a generally uniform structure of finely tempered martensite was loaded into the wheel blaster. The shot had a size such that 96% of the pellets were greater than Tyler screen 25 and had a Rockwell Hardness between 40 and 50. The casing was fed through the wheel blasting machine at a rate of 25 feet per minute, resulting in a reduction in the slot size with the treated casing having slots of a width of 0.014+/−0.002 inches.

It will thus be appreciated that through the employment of the method described herein there is presented the ability to reduce the width of slots or openings in a pipe, tube or tubular member, or for that matter any other structure or object, in a quick, efficient, accurate and cost effective manner. The method removes the need to use seaming and other techniques common in the prior art. As a result, alignment issues common in presently used methods to reduce slot widths are non-existent. Further, the applicant's method has been shown to increase production rates by in some cases 20 times that available through the use of conventional equipment and methodologies. The applicant's method also permits for adjustment to be made to a manufacturing process to quickly and easily accommodate tubulars or objects of varying sizes and having slots or openings that require varying degrees of reduction in their size. Accommodating different sizes of tubulars or objects to be treated, and treating different widths of slots or openings with conventional equipment, typically requires a complete recalibration of relatively complex machinery that is both costly and time consuming.

It is to be understood that what has been described are the preferred embodiments of the invention and that it may be possible to make variations to these embodiments while staying within the broad scope of the invention. Some of these variations have been discussed while others will be readily apparent to those skilled in the art. For example, while in the method described above the tubular is rotated as it is fed through the wheel blasting machine to expose its entire surface to bombardment, in an alternate embodiment the wheel blasting machine may include a plurality of impellers positioned at locations circumferentially surrounding the tubular, removing the need to rotate the tubular.

We claim:

1. A method for reducing the width of slots spaced about the surface of a pipe or tube, the method comprising subjecting the surface of the pipe or tube to bombardment by a quantity of shot of a pre-determined size and for a pre-determined length of time to cause deformation of the surface of the pipe or tube adjacent to the slots therein such that the width of the slots is reduced to within a pre-determined size range.

2. The method as claimed in claim 1 wherein the width of the slots in the pipe or tube is reduced by a ratio of from 2:1 to 1.5:1.

3. The method as claimed in claim 1 wherein said shot is formed from heat treated steel with a Rockwell Hardness of between 40 and 50 and is generally spherical in shape having a diameter greater than the width of the slots in the pipe or tube prior to bombardment.

4. The method as claimed in claim 1 wherein the shot is generally spherical in shape and is of a size range such that the smallest shot has a diameter that is at least 25 percent larger than the width of the slots in the pipe or tube prior to bombardment.

5. The method as claimed in claim 1 wherein said shot is steel or stainless steel and of a size greater than the width of the slots in the pipe or tube prior to bombardment.

6. A method for reducing the width of slots spaced about the surface of a pipe or tube, the method comprising subjecting the surface of the pipe or tube to bombardment by a quantity of shot of a pre-determined size and for a pre-determined length of time to cause deformation of the surface of the pipe or tube adjacent to the slots therein such that the width of the slots is reduced to within a pre-determined size range, the method including the step of carrying out said bombardment of the surface of the pipe or tube within a blast cabinet, the pipe or tube conveyed through the blast cabinet at a pre-determined feed rate to subject the surface of the pipe or tube to bombardment by shot for said pre-determined time.

7. The method as claimed in claim 6 including the step of rotating the pipe or tube about its longitudinal axis as it is fed through the blast cabinet and subjected to to bombardment by said shot.

8. The method as claimed in claim 7 wherein said blast cabinet comprises a portion of a pneumatic blasting machine, said step of bombarding the surface of the pipe or tube with shot accomplished through the use of a pneumatic blasting machine.

9. A method for reducing the width of slots spaced about the surface of a pipe or tube, the method comprising subjecting the surface of the pipe or tube to bombardment by a quantity of shot of a pre-determined size and for a pre-determined length of time to cause deformation of the surface of the pipe or tube adjacent to the slots therein such that the width of the slots is reduced to within a pre-determined size range, wherein the bombardment of the surface of the pipe or tube with shot accomplished through the use of a wheel blasting machine.

10. A method for reducing the width of slots spaced about the surface of a pipe or tube, the method comprising subjecting the surface of the pipe or tube to bombardment by a quantity of shot of a pre-determined size and for a pre-determined length of time to cause deformation of the surface of the pipe or tube adjacent to the slots therein such that the width of the slots is reduced to within a pre-determined size range, said shot generally spherical in shape and having a diameter of from five to ten times the width of the slots in the pipe or tube prior to bombardment.

11. A method to reduce the width of slots in tubular liners used in oil, gas or water wells so that the width of the slots is sufficiently small to prevent or limit the ingress of sand, rock, or other particulate material into the interior of the tubular liner when the liner is inserted into a bore hole, the method comprising subjecting the exterior surface of the tubular liner to bombardment by a quantity of shot of a pre-determined size and for a pre-determined length of time such that the impact of the shot against the exterior surface of the tubular liner causes metallic deformation of the surface of the liner adjacent to the slots and a resulting reduction in the width of the slots.

12. The method as claimed in claim 11 wherein said bombardment of said surface of said tubular liner by said shot is accomplished through the use of a wheel blasting machine.

13. The method as claimed in claim 11 wherein said bombardment of said surface of said tubular liner by said shot is accomplished through the use of a pneumatic blasting machine.

14. The method as claimed in claim 11 including the step of rotating the tubular liner about its longitudinal axis as its outer surface is bombarded with said shot.

15. A method to reduce the width of slots in tubular liners used in oil, gas or water wells so that the width of the slots is sufficiently small to prevent or limit the ingress of sand, rock, or other particulate material into the interior of the tubular liner when the liner is inserted into a bore hole, the method comprising subjecting the exterior surface of the tubular liner to bombardment by a quantity of shot of a pre-determined size and for a pre-determined length of time such that the impact of the shot against the exterior surface of the tubular liner causes metallic deformation of the surface of the liner adjacent to the slots and a resulting reduction in the width of the slots, said shot generally spherical in shape and is of a size range such that the smallest shot has a diameter that is at least 25 percent larger than the width of the slots in the tubular liner prior to bombardment.

16. A method to reduce the width of slots in tubular liners used in oil, gas or water wells so that the width of the slots is sufficiently small to prevent or limit the ingress of sand, rock, or other particulate material into the interior of the tubular liner when the liner is inserted into a bore hole, the method comprising subjecting the exterior surface of the tubular liner to bombardment by a quantity of shot of a pre-determined size and for a pre-determined length of time such that the impact of the shot against the exterior surface of the tubular liner causes metallic deformation of the surface of the liner adjacent to the slots and a resulting reduction in the width of the slots, the method including the further step of applying a protective film or coating over the exterior surface of the tubular liner following bombardment.

* * * * *